United States Patent [19]

Schiavone

[11] Patent Number: 4,631,505

[45] Date of Patent: Dec. 23, 1986

[54] RIGHT ANGLE MICROWAVE STRIPLINE CIRCUIT CONNECTOR

[75] Inventor: Frank J. Schiavone, Ridgecrest, Calif.

[73] Assignee: The United States of America as represented by the Secretary of the Navy, Washington, D.C.

[21] Appl. No.: 730,018

[22] Filed: May 3, 1985

[51] Int. Cl.[4] ..... H01P 5/08

[52] U.S. Cl. ..... 333/33; 333/260

[58] Field of Search ..... 333/33, 260

[56] References Cited

U.S. PATENT DOCUMENTS

| | | | |
|---|---|---|---|
| 2,938,175 | 5/1960 | Sommers et al. | 333/33 X |
| 3,155,930 | 11/1964 | Lovejoy . | |
| 3,201,722 | 8/1965 | May et al. . | |
| 3,496,515 | 2/1970 | Painter . | |
| 3,757,272 | 9/1973 | Laramee et al. | 333/260 X |
| 4,280,112 | 7/1981 | Eisenhart . | |
| 4,346,355 | 8/1982 | Tsukii . | |

*Primary Examiner*—Paul Gensler

*Attorney, Agent, or Firm*—W. Thom Skeer; Stephen J. Church

[57] ABSTRACT

A connector between a stripline circuit and a coaxial conductor disposed at a right angle. The connector provides a low VSWR at relatively high frequencies and is attachable without soldering or separation of the circuit layers and with access from only one side of a first one of the circuit ground plane plates. This plate and an adjacent first outer dielectric circuit board have openings exposing a conductive stripe on a center board. The second plate is exposed by smaller openings in an adjacent second outer board and the center boards, and the connector has a body extending from the coaxial conductor to the second plate. The body has an outer conductor flatly and axially contacting the second plate and having a flange fitted to the smaller openings. The body has a tab extended radially from a central conductor and outwardly of the flange to engage the stripe. The body has a dielectric disposed between its conductors and extending axially between its ends and radially about the tab to the flange periphery. A dielectric ring is disposed about the flange filling the opening in the first board, and a flexible, conductive ring extends over the dielectric ring and between the flange and the first plate. The connector has a clamp ring axially engaging the flexible ring and the flange and secured to the second plate by screws extending through the rings.

10 Claims, 4 Drawing Figures

Fig. 1
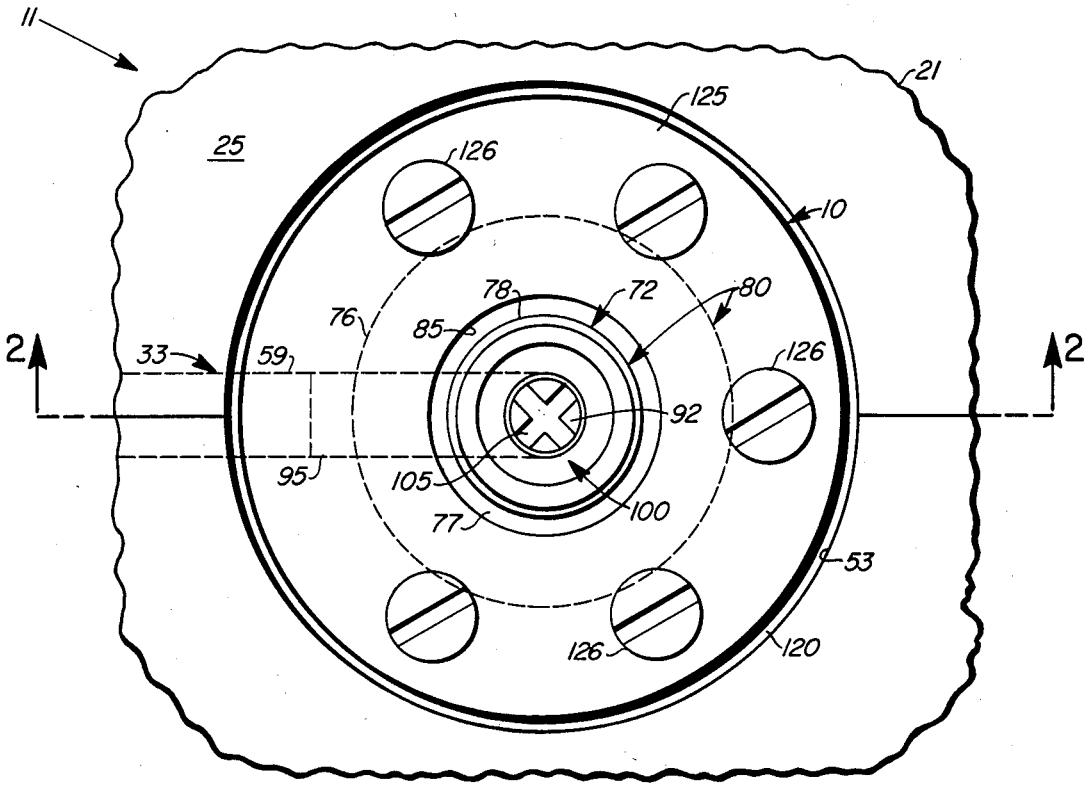
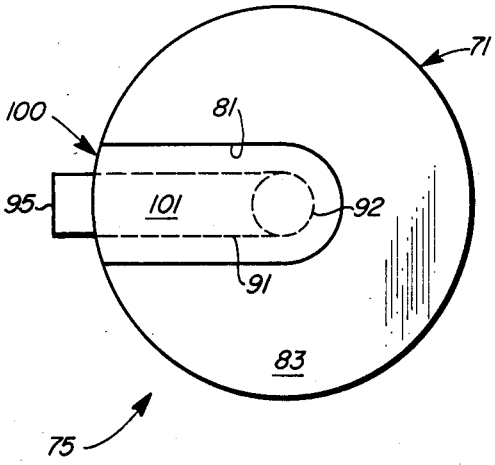
Fig. 3
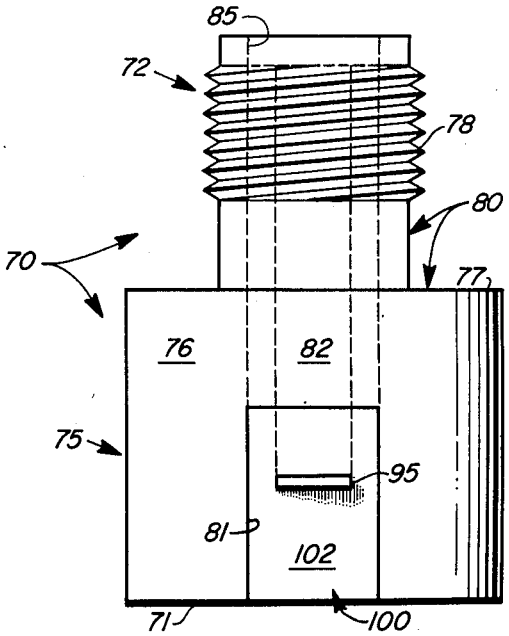
Fig. 4

RIGHT ANGLE MICROWAVE STRIPLINE CIRCUIT CONNECTOR

BACKGROUND OF THE INVENTION

1. Field of the Invention

The subject invention pertains to electrical connectors used in wave transmission lines. More particularly, it pertains to high frequency, long line components, specifically connectors and interconnections between stripline and coaxial transmission lines.

2. Description of the Prior Art

Coaxial transmission lines having a central conductor and a circumscribing outer ground conductor separated by a dielectric tube are used to carry microwave signals to or from generally planar stripline circuits having a stripe of conductive material one one side of a central dielectric board which is disposed between a pair of outer dielectric boards which are, in turn, disposed between a pair of conductive ground planes. The difference in configuration between central and ground conductors in a stripline circuit and a coaxial conductor makes it difficult to provide an effective electric transition therebetween at microwave frequencies due to discontinuities in the conductors, due to less than optimal channeling of the electric fields of the central conductor within the ground conductor, and due to conduction by relatively irregular electric field reflecting elements such as screwthreads. As a result, connections between coaxial conductors and stripline circuits typically have a relatively high Voltage Standing Wave Ratio (VSWR) and cause loss of signal power and signal distortion.

Nevertheless, electrically and mechanically satisfactory connectors have been developed for connecting a coaxial conductor to a conductive stripe extending to the edge of a stripline board. However, this edge connection configuration may complicate installation of a stripline circuit. Further, edge connection is limited to the periphery of a circuit board and thus constrains circuit layout thereon. Right angle connectors have, therefore, been developed for connecting a stripline circuit and a coaxial conductor approaching the circuit perpendicularly. Although generally effective, prior art right angle conductors have relatively high VSWR ratios at frequencies approaching 18 GHz.

It is desirable that soldering not be required in a right angle stripline connector, as in other connectors, thereby facilitating original assembly and, particularly, facilitating maintenance of installed circuits. It is also desirable that a connector facilitate proper alignment of mating elements, particularly at microwave frequencies where relatively minor misalignment may cause serious electric field distortion. It is frequently necessary to dismount and then remount existing right angle connectors because of breakage or improper alignment with the associated conductive stripe. In many installations of a stripline circuit the side thereof toward a connected coaxial conductor is the only accessible side. However, insofar as known to the inventor, prior art right angle stripline connectors, however excellent their electrical characteristics, require access to both sides of an associated stripline circuit for their mounting and dismounting so that such work requires the relative involved removal and subsequent reinstallation of the circuit, often in cramped quarters.

SUMMARY OF THE INVENTION

The subject connector is for use between a coaxial conductor and a stripline circuit normal thereto and having a first ground plane plate, a first outer dielectric board, a center dielectric board bearing a conductive stripe on its side toward the first plate, a second outer dielectric board, and a second ground plane plate. The first plate and the boards have individual openings aligned to expose the second plate, the openings in the first plate and the first board being larger to expose the stripe. The connector has a body extended from the coaxial conductor through the openings so that an outer conductor of the body is in flat, endwise engagement with the second plate. This outer conductor has a flange fitted to the openings in the center and second boards. The body has a center conductor from which a tab extends outwardly of the flange at the plane of the stripe for engagement therewith. The body has a dielectric which surrounds the tab within the flange and which is disposed between the body conductors and between the tab and the second plate. The connector has a dielectric ring filling the first board opening outwardly of the flange and has a flexible, conductive ring disposed over the dielectric ring to extend the first plate ground plane to the flange. The connector has a detachable clamp member disposed oppositely of the conductive ring and the flange from the second plate to secure the rings and body to the circuit.

It is an object of the subject invention to provide, between a stripline circuit and a coaxial conductor normal thereto, a connection which has a relatively low VSWR over a wide range of frequencies to a frequency of at least 18 GHz.

Another object is to provide such a connection having elements which are conveniently mounted on and dismounted from the stripline circuit when access is available thereto from only one side.

Another object is to provide such a connection havings elements which can be so mounted and dismounted without separation of any of the circuit plates or boards, without soldering, and without special tools.

A further object is to provide such a connection which has the above advantages and which facilitates proper alignment of such elements which a conductive stripe of the circuit, to which existing stripline circuits can be readily adapted, and which is simple and economical to manufacture.

BRIEF DESCRIPTION OF THE DRAWINGS

Other objects, advantages, and novel features of the invention will become apparent from the following detailed description of the invention when considered with the accompanying drawings wherein:

FIG. 1 is an axial view of a right angle, microwave connector assembly embodying the principles of the subject invention and depicted with a fragmentarily represented stripline circuit;

FIG. 3 is an axial view of a connector body of the assembly;

FIG. 4 is a side view of the connector body.

DESCRIPTION OF THE PREFERRED EMBODIMENT

Figure 2:
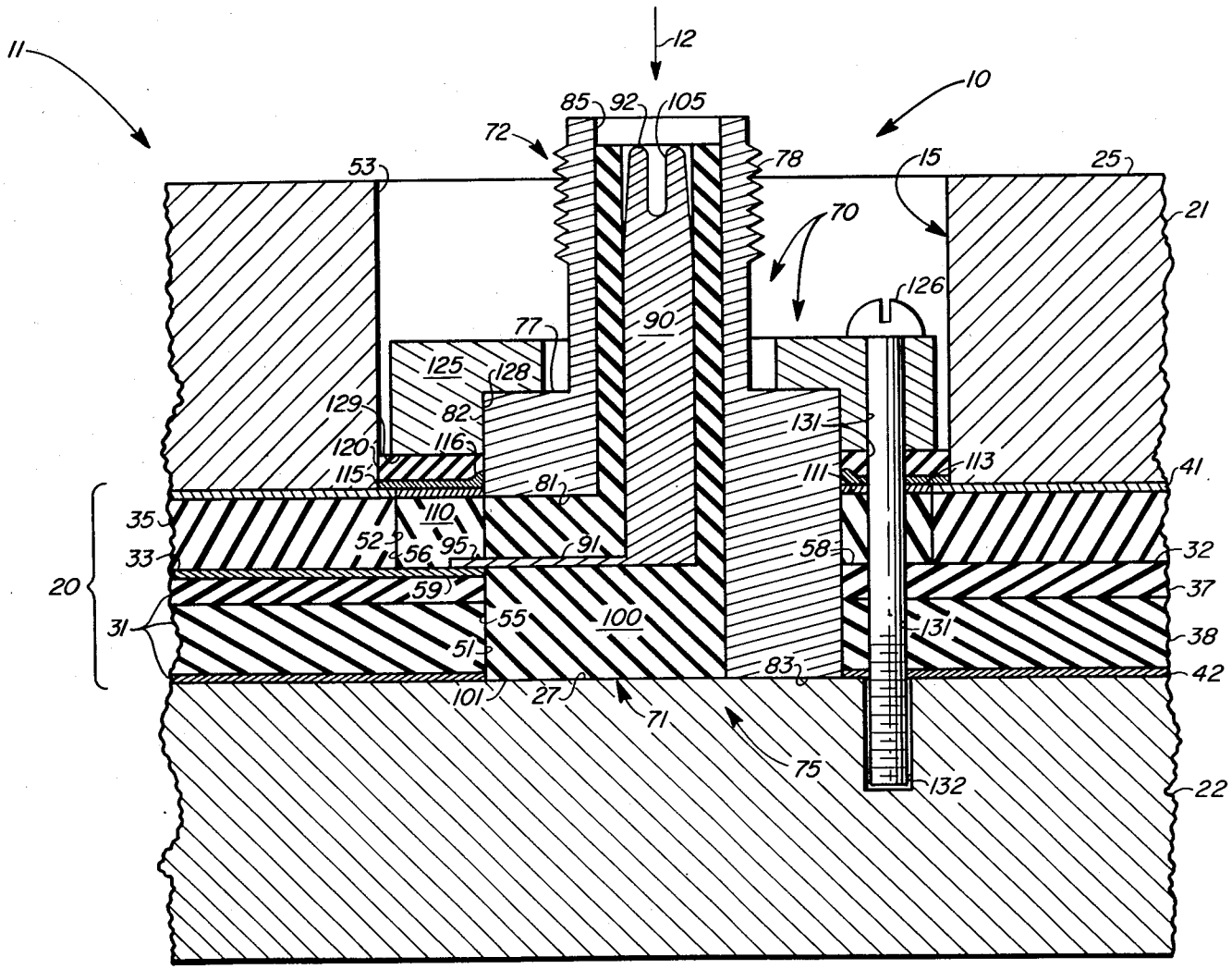
FIG. 2 is a section of the assembly and circuit of FIG. 1 taken on line 2—2 thereof.

Referring to the drawings in greater detail, FIGS. 1 and 2 show a connector 10 and a generally planar stripline circuit transmission line 11 embodying the subject invention. Connector 10 serves to connect circuit 11 to a well-known coaxial conductor, not shown, extending axially toward circuit 11 in a direction 12 normal thereto. The coaxial conductor has a central conductor, a tubular outer conductor circumscribing the central conductor, and a tubular dielectric therebetween. Circuit 11 defines a generally cylindrical socket 15 which receives connector 10 and is aligned axially with direction 12.

The portion of circuit 11 remote from socket 15 is of well-known construction for use with microwave frequencies and has a central dielectric 20 disposed between a first metal ground plane, ground plane layer, or ground plane plate 21 and a second such plate 22. Plate 21 has an outer side 25, which is a side of circuit 11 disposed toward direction 12, and plate 22 has a similarly disposed interior side 27. Dielectric 20 is, typically, constructed of a first planar dielectric layer 31 bearing, on a side 32 thereof toward plate 21, a conductive stripe 33 and a second planar dielectric layer 35. Layer 31 may be constructed of a relatively thin sublayer 37 bearing stripe 33 and sublayer 38 corresponding in thickness to layer 35. It is apparent from FIG. 2 that dielectric 20 may be considered as a dielectric layer extending oppositely from stripe 33 to plates 21 and 22 and that plate 22 is spaced from side 25. It is also apparent that plate 21 is spaced from stripe 33 toward side 25 and that stripe 33 is disposed between plates 21 and 22. Preferably layer 35 and sublayers 37 and 38 are constructed of well-known Teflon fiberglass (TFG) material. Layer 35 and sublayer 38, typically, are provided with respective integral and relatively thin metallic layers 41 and 42 disposed toward the corresponding adjacent plate 21 or 22. It is evident that layers 41 and 42, electrically, are each a portion of the ground plane of the corresponding such plate.

Socket 15 is defined within dielectric 20 and plate 21 by three circular openings, namely a first opening 51 in layer 31, a second opening 52 in layer 35, and a third opening 53 in plate 21. Openings 51 through 53 are coaxially related and are aligned axially with direction 12 so that the openings are circular in the planes of the corresponding layers. Opening 52 is substantially larger in diameter, and therefore transversly wider, than opening 51, while opening 53 is somewhat larger in diameter than opening 52 and thus generally conforms thereto. It is apparent from FIG. 2 that socket 15 extends through dielectric 20 and through plate 21 from plate 22 to side 25 so that side 27 of plate 22 is accessible in direction 12 through openings 51 through 53.

Since opening 51 is smaller in diameter than opening 52, socket 15 has, within dielectric 20, a smaller diameter portion 55, which is adjacent to side 27 within opening 51 and has a larger diameter portion 56 spaced therefrom within opening 52 and extending from portion 55 to plate 21. Socket portions 55 and 56 are filled with portions, subsequently described, of connector 10 when the connector and circuit 11 are assembled as shown in FIGS. 1 and 2. Since opening 52 is larger than opening 51, socket 15 has, at the junction of portions 55 and 56, an annular surface 58 on side 32 of layer 31. Socket 15 is disposed so that stripe 33 extends radially therefrom and has a portion 59 disposed on surface 58 in juxtapositioned relation to opening 51 and adjacent to socket portion 55. Since openings 52 and 53 are larger in diameter than opening 51, socket 15 is wider transversely between stripe 33 and circuit side 25 so that stripe portion 59 is accessible from side 25 through dielectric layer 35 and socket 15.

Connector 10 has a generally cylindrical body 70, shown in FIGS. 1 through 4 and configured to be detachably received in openings 51 through 53 of socket 15 in coaxial relation thereto. Body 70 has a planar contact end 71 and has an opposite connector end or end portion 72 adapted, in a manner subsequently described, for mechanical and electrical connection of body 70 to a coaxial conductor constructed and disposed in relation to circuit 12 as before stated. Body 70 has an enlarged, peripherally cylindrical portion 75 having substantially the same diameter as opening 51 and slideably fitted thereto. Body portion 75 has a cylindrical peripheral surface 76 and extends from end 71 toward end portion 72 a distance substantially greater than the thickness of dielectric 20. Body 70 is thus configured for reception in socket 15 with body end 71 in flatly engaged, juxtapositioned relation to side 27 of plate 22 and with body portion 75 extending from plate 22 axially within socket 15 through openings 51 and 52 into opening 53, so that end portion 72 is disposed oppositely of layer 35 from layer 31. End portion 72 is substantially smaller in diameter than portion 75 so that body 70 has an annular shoulder 77 at the junction of these portions. Portion 72, typically, is provided with external screwthreads 78 spaced from portion 75.

Body 70 has a hollow or outer conductor 80, sometimes referred to in the claims as a "third conductor" of body 70. Conductor 80 bears the majority of the cylindrical periphery of body 70 and the majority of the surface of planar end 71. Conductor 80 has defined therein an opening or notch 81 which opens radially through body portion 75 and conductor 80. Notch 81, typically, opens through end 71 in a radially extending, U-shaped configuration shown in FIG. 3. Conductor 80 thus extends between body ends 71 and 72, bears screwthreads 78, bears a planar surface 83 which is disposed at body end 71 for engagement with plate 72, and is fitted peripherally to opening 51. As best seen in FIG. 2, notch 81 extends axially of conductor 80 from body end 71 and a distance equal to the thickness of dielectric 20 so that, axially from notch 81 to shoulder 77, conductor 80 is aligned with the ground planes of layer 41 and plate 21 and so that, within opening 53, the peripheral surface 76 of enlarged body portion 75 is the exterior surface of conductor 80. Side 82 of conductor 80 thus extends from notch 81 toward circuit side 25 from the ground plane of layer 41 and plate 21. It is apparent that notch 81 is disposed so that, when body 70 is received in socket 15, body 70 may be rotated about its axis to align the center of notch 81 with stripe 33. Conductor 80 has a central bore 85 concentric with screwthreads 78 and extending through body portion 72 to notch 81.

Body 70 has an inner conductor 90 consisting of a first portion 91 and of a second portion 92 electrically connected thereto. Portion 92, sometimes termed a "first conductor" of body 70 in the claims, extends generally normal to layers 31 and 35 while portion 91, sometimes termed in the claims a "second conductor" of body 70, extends generally parallel to these layers. Portion 92 is cylindrical and is configured to extend centrally within bore 85 form body end 72 to the plane of stripe 33 when body 70 is received in socket 15. Portion 91 is generally planar and extends radially of body 70 from portion 92 and centrally through notch 81 to a point outward of body portion 75, terminating in a tab 95 disposed to engage stripe portion 59 in overlapping relation on the side thereof opposite dielectric layer 31 when body 70 is inserted into socket 15 in direction 12. Tab 95 thus extends radially of body 70 a distance less than the difference between the radii of opening 52 and 51, extends between ends 71 and 72, and is disposed within opening 52 in layer 35 when body 70 is received in socket 15. It is evident from FIG. 2 that portion 92 extends from portion 91 inwardly of notch 81 and generally perpendicularly of portion 91 to body end 72. It is also apparent that inner conductor 90 is disposed generally within hollow conductor 80 and is spaced therefrom with conductor 80 circumscribing portion 92 and being spaced from portion 91 between portion 92 and stripe portion 59.

Body 70 has a body dielectric 100 which is disposed within hollow conductor 80, which surrounds inner conductor 90 except at tab 95, and which fills the space between these conductors. Dielectric 100 is disposed within notch 81 about portion 92 of conductor 90. Body 70 is configured so that, when it is received in socket 15, dielectric 100 extends oppositely from portion 92 substantially to the ground plane defined by layer 41 and plate 21 and to the ground plane defined by layer 42 and plate 22. Dielectric 100 has a portion 101 surrounding inner conductor portion 91 and extending inwardly from body side 82 within notch 81 to inner conductor portion 92. Dielectric 100 thus provides an exterior surface 102 thereof from which tab 95 extends. It is apparent that surface 102 is a region of peripheral surface 76 of body portion 75 and that this region is aligned axially and circumferentially of body portion 75 with stripe 33.

As shown in FIGS. 1 and 2 at body end 72, conductor portion 92, typically, is tapered and is provided with a cross-shaped notch 105 for connecting inner conductor 90 to the central conductor of a coaxial transmission line. Screwthreads 78 serve to connect outer conductor 80 to the outer conductor of such a transmission line and dielectric 100 conforms to and is aligned with the dielectric thereof. Any other suitable configuration of elements at body end 72 may, of course, be used to connect body 70 to a coaxial transmission line.

Referring to FIG. 2, it is apparent that opening 52 in dielectric layer 35 is configured to define, when body 70 is received in socket 15, an annular volume extending outwardly of body conductor 80 to layer 35 and extending between the plane of stripe 33 and plate 21. Connector 10 has a ring or filler dielectric 110 which conforms to this volume and is received therein. Ring 110 thus has a side 111 disposed toward circuit side 25 and fills opening 52 outwardly of body 70 between dielectric layer 32 and plate 21 so as to overlay stripe portion 59 and tab 95. Ring 110 is slideably fitted interiorly to body portion 75 and is slideably fitted peripherally to opening 52 so that ring 110 is detachably received therein. Ring 110, typically, is provided on its side 111 with a conductive layer 113 similar to layer 41 and aligned therewith.

A generally planar, flexible, and electrically conductive ring, washer, or cover conductor 115 is juxtapositioned to layer 113 at the side 111 of ring 110 opposite annular surface 58. Washer 115 is, typically, constructed of relatively soft and nonresilient aluminum foil. Washer 115 is coaxially related to ring 110 and has an outer diameter substantially equal to the diameter of opening 53 so as to overlap layer 41 about opening 52. The inner diameter of washer 115 before installation is somewhat less than the diameter of body portion 75 so that a lip 116 is formed centrally of washer 115 against body portion 75 when washer 110 is installed. Washer 115 thus extends between outer body conductor 80 and the ground plane of layer 41 and plate 21 with the washer periphery in electrically connecting relation to plate 21 and the washer interior in such relation with conductor 80 when body 70 is extended through washer 115. It is evident that washer 115 is detachably received in opening 53, is fitted peripherally therein so as to overlay ring 110, and centrally engages the exterior surface of conductor 80 within opening 53.

Connector 10 is provided with a compressible, electrically conductive ring 120 shown in FIG. 2. Ring 120 is juxtapositioned to washer 115 opposite dielectric ring 110 and, is, preferably, constructed of metal loaded elastomeric material well-known for use in stripline circuits. The interior diameter and the exterior diameter of ring 120 are substantially the same as, respectively, the diameter of body portion 75 and opening 52 so that compressible ring 120 is slideably receivable therebetween and has generally the same diameter as ring 110.

Referring to FIGS. 1 and 2, it is seen that Connector 10 is provided with a clamp ring 125 and with a plurality of screws 126 to detachably mount body 70, rings 110 and 120, and washer 115 on circuit 11 and within socket 15. Clamping ring 125 has an internal diameter somewhat larger than screwthreads 78 and has a counterbore 128 closely slideably fitted to body portion 75 at shoulder 77. Outwardly of counter bore 128, ring 125 has a planar, annular surface 129 conforming to conductive ring 120 and engaged therewith oppositely of washer 115. As shown in FIG. 1, screws 126 are spaced circumferentially about ring 120 except at stripe 33. Each screw 126 extends successively through corresponding aligned bores 131 in ring 125, ring 120, washer 115, ring 110, and layers 37, 38, and 42 into engagement with a screwthreaded bore 132 in plate 22. It is evident that clamp ring 125 is mounted on circuit 11 and is extended within opening 53 so that tightening screws 126 urges the clamp ring toward compressible and conductive ring 120 to expand the ring radially into electrically connecting engagement peripherally with plate 21 and into engagement centrally with outer conductor 80 of body 70. It will be apparent to one skilled in the art that some other arrangement than a plurality of circumferentially spaced screws 126 may be used to compress ring 120 and to retain body 70, rings 110 and 120, and washer 115 in socket 15 so long as tightening the arrangement does not misalign tab 95 with stripe 33. It is also apparent that keys, additional screws, welding, adhesives, or the like may be used to ensure such alignment or to permanently assemble the elements of connector 10 and stripline circuit 11.

OPERATION

The operation of the described embodiment of the subject invention will now be briefly described. Assuming that socket 15 is empty of the elements receivable therein, body 70 is inserted into socket 12 until end 71 engages plate 22. Body 70 is then turned until tab 95 engages stripe 33, this engagement being easily observed for precise alignment of the tab and stripe through openigns 52 and 53. Ring 110, washer 115, and ring 120 are then inserted into socket 15 about body 70 with their corresponding bores 131 in alignment. Ring 125 and screws 126 are then installed and the latter tightened. A coaxial conductor may then be connected to body end portion 72. The elements surrounding body 70 may, of course, be slid over a coaxial conductor previously secured to body 70 so that complete flexibility in the order of assembly is obtained with the subject invention. The coaxial conductor and body 70 can be conveniently dismounted by reversing these procedures. It is apparent that neither mounting connector 10 to circuit 11 or dismounting of the connector therefrom require soldering or any separation of the plates 21 or 22 or layers 31 and 35. It is also apparent that such mounting or dismounting requires access to circuit 11 only from side 25 thereof.

When connector 10 and circuit 11 are assembled as shown in FIG. 2 operation at relatively high frequencies with a relatively low VSWR is possible because of the effective channeling of electromagnetic energy from within conductor 80 between the ground plane of plate 21 and layer 41 and the ground plane of plate 22 and layer 42. Such channeling is effective because connection between outer conductor 80 and the latter plane occurs where surface 82 is flatly engaged with plate 22 and because the former plane is substantially unbroken due to overlapping by washer 115 of the junctions between layer 113 with layer 41 and body conductor 80. Any imperfections in such overlapping are covered when conductive ring 120 is compressed. Screws 126 are effectively short circuited by the connections just described between conductor 80 and such ground planes. It can be seen from FIG. 2 that dielectric 100 is aligned axially of body 70 with dielectric 20. With the described configuration of connector 10 and circuit 11 it is apparent that there are no irregular surfaces to reflect electromagnetic energy being transferred along inner conductor 90 to stripe 33 and that this energy is channeled within conductor 80 and the ground planes of circuit 11. As a result, the subject invention provides effective electrical connection between a coaxial conductor and a stripline circuit as well as providing convenient and effective mechanical connection therebetween.

Obviously many modifications and variation of the present invention are possible in view of the above teachings. It is, therefore, to be understood that, within the scope of the appended claims, the present invention may be practiced other than as specifically described.

What is claimed is:

1. A connector for use between a generally planar stripline circuit and a coaxial conductor extending perpendicularly thereto from one side thereof, the circuit having a ground plane spaced from said side and a conductive stripe disposed therebetween, the circuit defining a socket extending between said plane and said side, the socket having a greater transverse width between the stripe and said side than between the stripe and said plane so that the stripe is accessible through said socket from said side; the coaxial conductor having a central conductive element, an outer conductive element circumscribing said central element, and a dielectric disposed therebetween; and the connector comprising:

a body having opposite ends and being configured to be received in such a socket with one of the ends juxtapositioned to such a ground plane, the other of said ends being adapted for connection to such a coaxial conductor and the body having;

a hollow conductor extending between said ends and bearing a planar surface at said other end disposed for engagement flatly with such a ground plane, the hollow conductor defining in one side thereof an opening disposed for alignment centrally with such a stripe when the body is so received;

an inner conductor disposed generally within and spaced from the hollow conductor, the inner conductor having a first portion which extends generally parallel to such a ground plane when the body is so received and which extends through said opening, said first portion extending outwardly of the hollow conductor and, outwardly thereof, being disposed to engage the stripe when the body is inserted into the socket in a direction from said one side toward said ground plane, and said inner conductor having a second portion extending from said first portion inwardly of said opening and generally perpendicular thereto to said one end of the body; and means for releasably mounting the body on the circuit when the body is so received;

and means disposed at said one end of the body for electrically connecting the hollow conductor to said outer conductive element and for electrically connecting the inner conductor to said central conductive element.

2. The connector of claim 1:

wherein the connector is for use with such a circuit having another ground plane spaced from said stripe toward said one side of the circuit and having a dielectric layer extended oppositely from the stripe to each of said planes, said socket being defined within said dielectric layer and said other ground plane; and wherein the body is configured so that, when the body is so received, the dielectric thereof extends oppositely from said first portion of said inner conductor substantially to the plane of each of said ground planes and so that said one side of the hollow conductor having the opening defined therein extends therefrom in a direction toward said one side of the circuit from said another ground plane.

3. The connector of claim 2 wherein the connector is for use with such a circuit wherein said dielectric layer thereof is configured so as to define, when the body is so received, a volume extending outwardly of said hollow conductor to said layer and extending between the plane of the stripe and said another ground plane and wherein the connector further comprises:

a dielectric member conforming to said volume and detachably receivable therein, said member having a side disposed toward said one side of the circuit; a generally planar conductive member juxtapositioned to said side of said dielectric member and extending between said hollow conductor and said another ground plane; and means engaging said conductive member oppositely of said dielectric member for detachably mounting said members to said circuit.

4. The combination comprising:

a stripline transmission line having a plurality of parallel, planar layers including, a first dielectric layer defining a first opening extending through the layer, said layer bearing on one side thereof a conductive stripe having a portion juxtapositioned to said opening, a second dielectric layer juxtapositioned to said one side, and defining a second opening aligned with the first opening, the second opening having a greater width than the opening so that said portion of the stripe is accessible through said second layer, a first conductive ground plane layer disposed oppositely of the second dielectric layer from the first dielectric layer and defining a third opening aligned with and generally conforming to the second opening, and a second conductive ground plane layer disposed oppositely of said first dielectric layer from said stripe and accessible through said three openings;

a connector body received in said three opening, having a predetermined planar contact end flatly engaged with the second ground plane layer, and having an opposite connector end portion, said end portion being disposed oppositely of said second dieletric layer from said first dielectric layer and being adapted for connection to a coaxial transmission line approaching the stripline transmission line axially normal to said layers, the body having;

a first conductor extending centrally of the body from the connector portion thereof and generally normal to said layers;

a second conductor electrically connected with the first conductor and extending therefrom generally parallel to said layers so as to engage said portion of the stripe within the second opening and on the side of the stripe opposite the first dielectric layer, a hollow third conductor extending between the contact end of the body and the connector portion thereof, the third conductor being fitted peripherally to the first opening and being disposed in circumscribing, spaced relation to the first conductor and defining an opening through which the second conductor extends in spaced relation to the third conductor from the first conductor to said portion of the stripe; and a dielectric body disposed within the third conductor and surrounding the first conductor and the second conductor;

a filler dielectric filling the second opening outwardly of the body between the first dielectric layer and the first ground plane layer; and a flexible and generally planar cover conductor disposed within the third opening and extending from said body to the first ground plane layer so as to electrically connect said third conductor and the first ground plane layer.

5. The combination of claim 4:

wherein the body is detachably received in said three openings; the filler dielectric is detachably received in said second opening, and the cover conductor is detachably received in the third opening; and wherein the combination further comprises means mounted on the stripline transmission line and extended within the third opening for detachably retaining the body, the cover conductor, and the filler dielectric to the stripline transmission line.

6. The combination of claim 4:

wherein said three openings are substantially circular in the planes of the corresponding layers; the second opening is substantially larger in diameter than the first opening; and the third opening is larger in diameter than the second opening;

wherein the body has a cylindrical portion extending from the contact end of the body toward the connector end thereof through the first opening and the second opening in to the third opening, said cylindrical portion having substantially the the same diameter as the first opening and being slidably fitted thereto: and wherein, within the third opening, the peripheral surface of said cylindrical portion is an exterior surface of the third conductor;

wherein a region of said peripheral surface is aligned axially and circumferentially of said cylindrical portion with said portion of the stripe, said region being a exterior surface of a portion of the body dielectric surrounding the second conductor and extending there along from the first conductor to said region; and wherein the second conductor terminates in a tab extending radially from said region a distance less than the difference between the radius of the second opening and the first opening so that the tab overlaps said portion of the stripe on said side thereof opposite the first dielectric layer.

7. The combination of claim 6 wherein the filler dielectric is a ring slidably fitted interiorly to said cylindrical portion of the body and slidably fitted peripherally to the second opening so as to overlay the tab and said portion of the stripe.

8. The combination of claim 6 wherein the cover conductor is a ring which, centrally thereof, engages said exterior surface of the third conductor within the third opening and which, peripherally, is fitted within the third opening so as to overlay the filler dielectric.

9. A stripline transmission line for use with a generally cylindrical connector body having one end adapted for connection to a coaxial conductor, a planar opposite end, and a conductive tab extending radially of the body between said ends, the transmission line comprising a central dielectric disposed between a pair of substantially parallel and planar electrically conductive plates and the transmisison line defining a socket, which:

extends from the interior side of one of the plates through the central dielectric and the other of the plates;

is configured to receive such a body with the planar end thereof engaged with said interior side and the body extended therefrom within the socket toward said one plate; and has, within the central dielectric, a smaller diameter portion adjacent to said interior side and a larger diameter portion spaced therefrom and extending from said smaller diameter portion to said other of the plates so as to define in said dielectric an annular surface at the junction of said portions, and the transmission line having:

a conductive stripe disposed on said annular surface adjacent to said smaller diameter portion for engagement by the tap;

a dielectric ring slideably fitted centrally to such a body and slidably fitted peripherally to said larger diameter portion for reception therein in overlaying relation to such a tab and to the stripe subsequent to reception of such a body in the socket;

a flexible and electrically conductive washer coaxially related to the dielectric ring and juxtapositioned thereto oppositely of said annular surface with the periphery of the washer engaged in electrically connecting relation to said other plate, the washer being configured centrally for electrically connecting engagement with such a body extended through the washer; and mounting means for detachably retaining, such a body, the dielectric ring, and the washer in the socket.

10. The stripline transmission line of claim 9:

wherein said transmission line further comprises a compressible ring of electrically conductive, elastomeric material juxtapositioned to the washer oppositely of the dielectric ring and having generally the same interior diameter and the same exterior diameter as said ring; and wherein the mounting means includes;

an annular element conforming to the compressible ring and engaged therewith oppositely of the washer, and means for urging said element toward the compressible ring to expand the ring radially into electrically connecting engagement peripherally with said other plate and into such engagement centrally with such a body extending through the compressible ring.

* * * * *